United States Patent [19]

Frey, Jr. et al.

[11] 4,184,140

[45] Jan. 15, 1980

[54] TWO-PIECE TRIMMING POTENTIOMETER

[75] Inventors: Sydney W. Frey, Jr.; James E. Slagg, both of Brookfield, Wis.

[73] Assignee: Allen Bradley Company, Milwaukee, Wis.

[21] Appl. No.: 969,549

[22] Filed: Dec. 14, 1978

[51] Int. Cl.[2] ..... H01C 10/34

[52] U.S. Cl. ..... 338/174; 338/171; 338/163; 338/202

[58] Field of Search ..... 338/174, 171, 163, 202, 338/160, 162, 188, 190

[56] References Cited

U.S. PATENT DOCUMENTS

| | | | |
|---|---|---|---|
| 2,178,283 | 10/1939 | Lodge | 338/202 X |
| 3,448,428 | 6/1969 | Bang et al. | 338/162 |
| 3,772,630 | 11/1973 | Falco | 338/174 |
| 3,905,318 | 9/1975 | Andersen et al. | 339/252 R |
| 3,906,429 | 9/1975 | Rhodes | 338/171 X |
| 3,940,198 | 2/1976 | Andersen et al. | 339/5 M |
| 4,051,453 | 9/1977 | Barden | 338/171 |
| 4,105,988 | 8/1978 | Van Benthuysen et al. | 338/171 X |

*Primary Examiner*—C. L. Albritton

*Attorney, Agent, or Firm*—Quarles & Brady

[57] ABSTRACT

A trimming potentiometer (10) has a circuit track pattern (12) disposed on a base (11) having three integrally formed legs (11*d*). The track pattern (12) includes a collector track (12*a*), a resistance track (12*b*) and a pair of termination tracks (12*c*) connected to opposite ends of the resistance track (12*b*). Terminals for the device are formed by extending the collector track (12*a*)and the pair of termination tracks (12*c*) down the middle leg (11*d*) and the opposite outside legs (11*d*), respectively. A multi-functional contact (13) is rotatably mounted on the base (11) and includes multiple fingers (13*g*) that contact the resistance tracks (12*b*), dimpled areas (13*j*, 13*k*) which form projecting surfaces that contact the collector track (12*a*), a stop tab (13*l*) at its upper extremity that limits rotation, and outwardly extending notched tabs (13*m*) for receiving a suitable drive member to adjust the setting of the potentiometer (10).

6 Claims, 4 Drawing Figures

Fig. 1
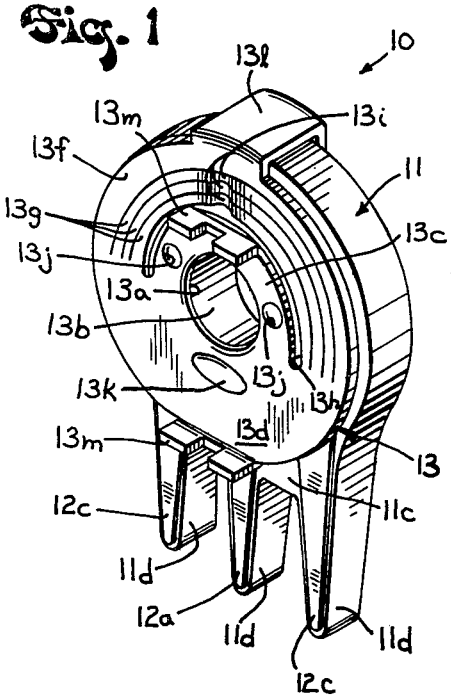
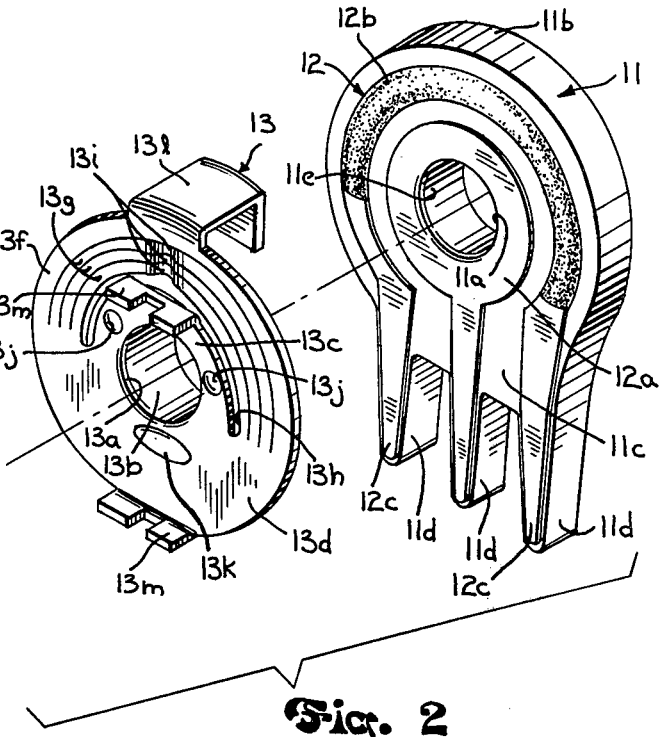
Fig. 2
Fig. 3
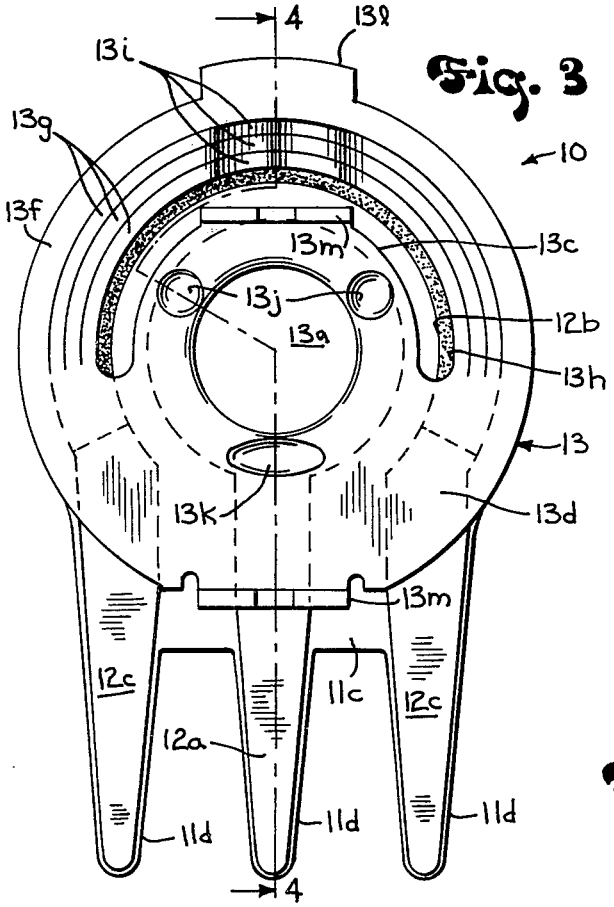
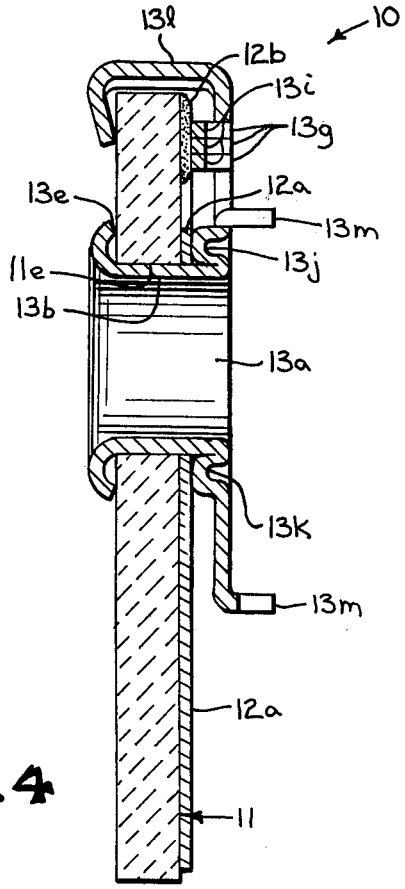
Fig. 4

TWO-PIECE TRIMMING POTENTIOMETER

TECHNICAL FIELD

The field of the invention is variable resistor controls, and more particularly, trimming potentiometers that can be used as either potentiometers or rheostats.

BACKGROUND ART

Many potentiometers are known in the field of electrical controls. Some of these are intended for use on a control panel as an externally accessible control. These controls are designed for repeated adjustment—usually through a rotable drive shaft on which a control knob is mounted—and are rated in some instances for one million operations.

Another type of potentiometer is a trimming potentiometer. This type of device is intended for mounting on a circuit board, or other supporting surface, which is usually housed within an item of electrical apparatus. This type of control is generally set at the beginning of its life, and in some instances, is only readjusted during its life when the circuit is serviced. Trimming potentiometers may be multi-turn or single-turn, and open-frame, partially open-frame, or sealed. Such devices may be used as rheostats by connecting two terminals, a fixed terminal and another terminal that is connected to an adjustable wiper contact, in series in an electrical circuit.

The competing considerations in the manufacture of a trimming potentiometer are cost versus the specification requirements for the device. At one end of this cost spectrum are high-cost devices that are designed to meet stringent military specifications. At the other end of the spectrum are low-cost devices which satisfy a particular commercial demand.

One way of reducing manufacturing costs is reducing the number of parts required to make a trimming potentiometer. Another way of reducing these costs is providing a structure that requires a small number of inexpensive manufacturing and assembly steps.

In Falco, U.S. Pat. No. 3,772,630, issued Nov. 13, 1973, a potentiometer that is presented as simple and inexpensive includes a base with a resistance track mounted thereon, a collector having an annular portion, and three connecting tags. One tag is electrically connected to the collector, and the other two tags are connected to the opposite ends of the resistance track. A slider is rotatably mounted on the annular portion of the collector and has a stud for contacting the resistance track.

In Bang, et al., U.S. Pat. No. 3,448,428, issued June 3, 1969, metal tags or terminal pins are made unnecessary by coating tongues extending from a rectangular base with either a resistive material or a metal plating material. The collector is formed either as a track on the opposite side of the base from the resistance element, or as a plate disposed within a housing with the base. Where a collector track is formed, a rotatable shaft is journaled through the base and carries a wiper contact finger on each side of the base with contacts engaging the resistance element on one side and the collector track on the other side. Where a housing is included in the structure, the wiper contact is more intricately mounted.

While these prior art devices strive for simplified and less expensive construction, it should be apparent from the following description that those objects are more readily obtained with a device as described herein.

DISCLOSURE OF THE INVENTION

The invention relates to a variable resistor control having a base on which a circuit track pattern is formed and having a movable contact. The track pattern includes a resistance track, a pair of termination tracks connected to opposite ends of the resistance track, and a collector track. The movable contact includes a first surface that engages the resistance track, a second surface that engages the collector track, and an annular flange that rotatably mounts the contact on the base.

More particularly, the base has oppositely facing front and back surfaces and an aperture that extends through the base between top and bottom surfaces to form a bearing. The tracks in the track pattern are disposed on the front surface of the base. The collector track includes an arcuate portion that extends along the edge of the aperture, and a portion that extends radially outward from the aperture. The arcuate resistance track lies outside the collector track and has a pair of termination tracks connected to its opposite ends. The termination tracks are spaced on opposite sides of the radially extending portion of the collector track and form two terminals for connection to a source of input voltage in an electrical circuit.

The movable contact has a body that is spaced from the track pattern on the base. The annular flange projects from the contact body and is rotatably mounted in the bearing formed in the base to define an axis of rotation for the contact. A collector engagement surface also projects from the contact body and slidably engages the collector track. An arcuate contact finger is connected at opposite ends to the contact body and has a projecting surface that slidably engages the resistance track.

It can be seen that the track pattern can be completely formed on one side of the base, thus eliminating the need for wiper arms and contacts on opposite sides of the base. The multi-functional contact engages both the resistance track and the collector track, and is connected directly to the base, thus eliminating the need for a separate collector that mounts a slider to the base.

In a specific embodiment of the invention, the movable contact is of the multi-finger type. A stop is formed as a tab that extends from an edge of a semicircular rim that is attached at its ends to the main body of the movable contact. A pair of notched flanges extend outwardly from the main body of the contact to provide a means for receiving the end of a rotatable drive member, such as a screwdriver.

The provision of all of these elements in a contact stamping enhances the low cost of manufacture of a trimming potentiometer. The number of parts requiring mechanical assembly has been reduced to its absolute minimum—two, one being an insulator with a conductive track pattern, and the other being a conductor for connecting portions of the track pattern.

One object of the invention is to provide a trimmer for use as a potentiometer or rheostat that can be embodied in two pieces.

Another object of the invention is to provide a trimming potentiometer that is simply and inexpensively manufactured and assembled.

Another object of the invention is to provide a trimmer that can be made small in size.

The foregoing and other objects and advantages of the invention will appear from the following description. In the description reference is made to the accompanying drawing, which forms a part hereof, and in which there is shown by way of illustration a preferred embodiment of the invention. Such embodiment does not necessarily represent the full scope of the invention, however, and reference is therefore made to the claims herein for interpreting the scope of the invention.

BRIEF DESCRIPTION OF THE DRAWING

FIG. 1 is a view in perspective of a variable resistor control that embodies the present invention.

FIG. 2 is an exploded view in perspective of the variable resistor control of FIG. 1.

FIG. 3 is a top view of the variable resistor control of FIG. 1.

FIG. 4 is a sectional view taken in the plane indicated by lines 4—4 in FIG. 3.

BEST MODE OF CARRYING OUT THE INVENTION

Referring to FIGS. 1 and 2, a trimming potentiometer 10 that embodies the present invention has a base 11 with a circuit track pattern 12 on its front surface and a movable contact 13 connected to the base 11. In this embodiment the base 11 is an alumina ceramic, however, other suitable insulating materials can also be used. The base 11 has a circular body portion **11*a* with a centrally located, cylindrical aperture 11*b*, and a depending portion 11*c* that includes three spaced, depending, ceramic legs 11*d*. The cylindrical aperture 11*b* extends through the base 11 between oppositely facing front and back surfaces to form a bearing 11*e* in which the contact 13** is mounted for rotation, as explained more fully below.

As seen in FIG. 2, the track pattern 12 includes a collector track **12*a* with an annular portion that encircles the central aperture 11*b*, and a depending portion that extends from the annular portion down the front side of the middle leg 11*d*. An arcuate resistance track 12*b* is disposed along a portion of a circular path that is concentric with the central aperture 11*b* and the annular portion of the collector track 12*a*, the resistance track 12*b* being disposed radially to the outside of the collector track 12*a*. A pair of termination tracks 12*c* are each connected at one end to a respective end of the resistance track 12*b* by overlaying one end upon the other. The termination tracks 12*c* extend from these connections down the front sides of opposite outside legs 11*d* of the base 11. The thickness of each track in the pattern 12** has been exaggerated in the drawing as an aid in disclosing the invention.

The track pattern 12 is formed with cermet materials and techniques which are well known in the art of making variable resistors. The materials are applied in the form of inks. The resistance track ink contains particles of a material that impart a preselected resistance per unit area per mil thickness. The inks for the collector track **12*a* and termination tracks 12*c* contain a silver powder that imparts good conductivity and negligible resistance to these tracks 12*a*, 12*c*. The inks may be applied by brushing, dipping, silk screening or other known deposition procedures. All of the inks include a vehicle, which can be an organic carrier, and this vehicle is decomposed by applying heat, leaving the dried track pattern 12. The other necessary procedure is firing the tracks 12*a*–12*c* as they are individually applied, or co-firing the entire track pattern 12**, to form the glass matrices which are characteristic of cermet materials. Further information concerning these techniques is disclosed in Brandt et al., U.S. Pat. No. 3,887,893, issued June 3, 1975.

It should be apparent from this description of the base 11 and the track pattern 12 that it is intended that the ceramic legs **11*d* be inserted in a circuit board or other supporting surface. It should also be apparent that the portion of the collector track 12*a* and the portions of the termination tracks 12*c* that are disposed on the ceramic legs 11*d*, can be extended around the sides and backs of these legs 11*d* to increase the number of solderable surfaces. This is not necessary, however, to practice the invention. The track portions on the legs 11*d*** are provided for electrical connection by soldering or other means, and the cermet materials that are selected for these areas should be able to withstand soldering.

The multi-functional contact 13 is a stamping of a suitable conductive metal, and is formed in the shape seen best in FIGS. 2 and 3. The contact 13 has a centrally located aperture **13*a* that is formed by an annular flange 13*b* seen in FIG. 4. The flange 13*b* projects from a portion of the contact 13 formed by a semiannular hub section 13*c* and a semicircular lower half portion of the contact 13, which together shall be referred to as the body 13*d* of the contact 13. The annular flange 13*b* is seated in the bearing 11*e* formed in the base 11 and is held by a rim at its free end that is roll-crimped to curl around the bottom edge of the central aperture 11*b* in the base 11 to form an abutment 13*e*. The annular flange 13*b* is rotatable within the bearing 11*d* and defines an axis of rotation for the contact 13. Thus, the first function of the contact 13 is that of a fastener which holds itself in operating position on the base 11**.

Referring again to FIGS. 2 and 3, the upper half of the contact 13 is divided into semiannular sections that are connected at opposite ends to the contact body **13*d*. A semiannular rim 13*f* extends around the outside of the upper half of the contact 13. An outer, semiannular contact finger 13*g* is positioned inside this rim 13*d*, and other semiannular contact fingers 13*g* are successively positioned inside the outer contact finger 13*g* at progressively shorter radial distance from the contact axis of rotation. The inside contact finger 13*g* is separated along its inside edge from the semiannular hub 13*c* by a semiannular slot 13*h*. Midway between their ends the contact fingers 13*g* each have a dimpled portion 13*i* so that a portion of each finger 13*f* projects towards and engages the resistance track 12*b* as seen in FIG. 4. The fingers 13*f* are of a thickness which, for the material composing them, makes them resilient. Various kinds of multi-finger contacts, and methods for making the same, are well-known in the art. For example, see Anderson et. al, U.S. Pat. No. 3,940,198, Anderson et. al, U.S. Pat. No. 3,905,318 and Lodge, U.S. Pat. No. 2,178,283. The multiple fingers 13*g* provide the second function of the contact 13, which is to act as a slidable contact along the resistance track 12*b***.

Besides the dimpled areas **13*i* formed on the contact fingers 13*g*, there are also dimpled areas 13*j*, 13*k* formed on the contact body 13*d*, as seen in FIG. 3. These dimpled areas 13*j*, 13*k* are disposed radially from the contact axis of rotation along radii that are spaced 120° apart. Two dimpled areas 13*j* are circular and are formed on the right and left sides, respectively, of the semiannular hub 13*c*. A third, oblong dimpled area 13*k* is formed on the contact body 13*d*** below the aperture 13*a*. These dimpled areas 13*j*, 13*k* form projecting surfaces, seen in FIG. 4, that engage the collector track 12*a* when the contact 13 is assembled to the base 11. Thus, the third function of the contact 13 is to provide an engagement surface that slides along the collector track 12*a* and electrically connects the collector and resistance tracks 12*a*, 12*b*.

The fourth function of the contact 13 is to provide a stop to limit its rotation. A stop tab 131 is connected to the the rim 13*f* of the contact 13, is wrapped around a peripheral side surface of the base 11, and has a portion overhanging the adjoining bottom surface. With this shape the tab 131 will be blocked by either one of the outside legs 11*d* of the base 11 when it is rotated into contact therewith, thereby limiting rotation of the contact 13 to 240°. As seen best in FIG. 4, the overhanging portion of the stob tab 131 also holds the dimpled portions 13*i* of the contact fingers 13*g* in engagement with the resistance track 12*b*.

A pair of notched tabs 13*m* extend outwardly from the plane of the contact body 13*d*. The upper notched tab 13*m* is formed on the contact hub 13*c* along the inside edge of the arcuate slot 13*h* so that its notch is aligned along a vertical axis extending through the dimpled portions 13*i* of the contact fingers 13*g*. The lower notched tab 13*m* is integrally formed on the contact body 13*d* at its lower extremity and has a notch in its free end that is aligned with the notch in the upright tab 13*m* aong the vertical axis. The notched tabs 13*m* provide a means for receiving an end of a suitable drive member, such as a screwdriver. Such a drive member can be located in the notches and rotated to adjust the position of the contact 13. Thus, the fifth function of the contact 13 is to provide a portion that is adapted to be coupled to such an adjustment tool.

The trimming potentiometer 10 just described has the fewest parts possible in such a device. The contact 13 is constructed in the most straightforward manner that provides the five functions described. The use of material in the contact 13 has been minimized and the operations for forming the contact are relatively simple, as will be recognized by those skilled in the art. The need for metal terminal pins on the base 11 has been eliminated by forming termination areas 12*a*, 12*c* on the integral ceramic legs with cermet materials and techniques.

The embodiments of the invention in which an exclusive property or privilege is claimed are defined as follows:

1. A variable resistor control which comprises:

a base having oppositely facing front and back surfaces and an aperture extending therethrough between the front and back surfaces to form a bearing, the base also having a track pattern disposed on one of its surfaces which includes a collector track with an arcuate portion extending along the edge of the aperture, and with a portion extending radially outward from the aperture, an arcuate resistance track spaced from the arcuate portion of the collector track and having a pair of opposite ends, and a pair of termination tracks each connected to a respective end of the resistance track, the termination tracks being spaced on opposite sides of the radially extending portion of the collector track; and a movable contact having a body spaced from the track pattern, an annular flange projecting from the contact body and rotatably mounted in the bearing formed in the base to define an axis of rotation for the contact, a collector engagement surface also projecting from the body of the contact and slidably engaging the collector track, and an arcuate contact finger having its opposite ends connected to the contact body and having a projecting surface formed intermediate its ends and slidably engaging the resistance track.

2. The control of claim 1, wherein the contact body includes a plurality of projecting surfaces that are disposed to contact the collector track at positions spaced along the length of that track.

3. The control of claim 1 or 2, wherein the contact includes a plurality of arcuate fingers, each having opposite ends connected to the body of the contact, each finger also having a projecting surface formed intermediate its ends that slidably engages the resistance track.

4. The control of claim 1, wherein the contact further includes an arcuate slot that separates the contact finger along its inside edge from the body of the contact; and wherein a pair of tabs extend outwardly from the body of the contact, one tab being formed along the inside edge of the slot, and another tab being formed along an outside edge of the contact body, the tabs each having a notch that is aligned with the notch of the other tab.

5. The control of claim 1, wherein the contact further includes an arcuate rim disposed along an outside edge of the contact finger and having opposite ends that are connected to the body of the contact, the rim having a tab on its outer edge that wraps around a peripheral side surface of the base to form a stop.

6. The control of claim 1, wherein: the base has a body portion, and a middle leg and two outside legs extending in the same direction from the body portion;

wherein the collector track extends down the middle leg; and wherein the termination tracks extend down opposite outside legs of the base.

* * * * *